US005737819A

United States Patent [19]

Sawdon et al.

[11] Patent Number: 5,737,819

[45] Date of Patent: Apr. 14, 1998

[54] FASTENING APPARATUS

[75] Inventors: Stephen E. Sawdon, Marysville; Edwin G. Sawdon; Gregory K. Allison, both of St. Clair, all of Mich.

[73] Assignee: BTM Corporation, Marysville, Mich.

[21] Appl. No.: 438,383

[22] Filed: May 10, 1995

[51] Int. Cl.[6] ..... B23P 11/00

[52] U.S. Cl. ..... 29/243.5

[58] Field of Search ..... 29/243.5, 21.1, 29/509, 293.52, 293.53, 283.5, 522.1, 798, 524.1; 72/482.91; 294/99.1, 99.2; 437/819, 820, 821

[56] References Cited

U.S. PATENT DOCUMENTS

| | | | |
|---|---|---|---|
| 1,919,999 | 7/1933 | Borton . | |
| 2,254,558 | 9/1941 | Williams . | |
| 2,562,071 | 7/1951 | Stveland | 294/99.1 |
| 2,626,687 | 1/1953 | Williams . | |
| 2,671,361 | 3/1954 | Sandberg . | |
| 2,713,197 | 7/1955 | Schmidt . | |
| 2,811,880 | 11/1957 | Williams . | |
| 3,022,687 | 2/1962 | Richards . | |
| 3,058,214 | 10/1962 | Mekler . | |
| 3,177,506 | 4/1965 | Vellier . | |
| 3,222,779 | 12/1965 | Zinniger . | |
| 3,324,491 | 6/1967 | Gutshall . | |
| 3,579,809 | 5/1971 | Wolf et al. . | |
| 3,771,216 | 11/1973 | Johnson . | |
| 3,967,816 | 7/1976 | Ramsperger et al. | 269/900 |
| 4,208,776 | 6/1980 | Schleicher . | |
| 4,459,735 | 7/1984 | Sawdon . | |
| 4,541,311 | 9/1985 | Trammell | 294/99.2 |
| 4,610,072 | 9/1986 | Muller . | |
| 4,633,559 | 1/1987 | Loren . | |
| 4,752,993 | 6/1988 | Oaks . | |
| 4,757,609 | 7/1988 | Sawdon . | |
| 4,803,767 | 2/1989 | Obrecht et al. . | |
| 4,825,525 | 5/1989 | Obrecht et al. . | |
| 4,846,518 | 7/1989 | Hamel | 294/99.1 |
| 4,879,806 | 11/1989 | Feng | 294/99.2 |
| 4,928,370 | 5/1990 | Eckold et al. | 29/21.1 |
| 4,941,700 | 7/1990 | Lin et al. | 294/99.2 |
| 5,031,442 | 7/1991 | Kynl . | |
| 5,051,020 | 9/1991 | Schleicher . | |
| 5,208,973 | 5/1993 | Sawdon . | |
| 5,230,136 | 7/1993 | Cronn et al. . | |
| 5,315,743 | 5/1994 | Schleicher . | |
| 5,490,310 | 2/1996 | Schleicher | 29/243.5 |

FOREIGN PATENT DOCUMENTS

| | | |
|---|---|---|
| 2852909A1 | 6/1980 | Germany . |
| 3021332A1 | 12/1981 | Germany . |
| 54-113753 | 9/1979 | Japan . |
| 404284928 | 10/1992 | Japan . |
| 895561 | 5/1962 | United Kingdom . |
| WO91/15316 | 10/1991 | WIPO . |

OTHER PUBLICATIONS

English Summary of Japanese Publication No. 54–113753 (attached to patent) "DE–STA–CO Durchsetzfuge–Technik", Sep. 1993, 4 pages.

BTM Lance–N–Loc & Tog–L–Loc Brochure, 1 page, prior to May 10, 1994.

BTM Punch Tech Brochure, 4 pages, 1983.

BTM The Tog–L–Loc System Brochure, 13 pages, 1992.

J. M Sawhill, Jr. & S. E. Sawdon, "A New Mechanical Joining Technique for Steel Compared with Spot Welding", 830128, SAE Technical Paper Series, 15 pages, 1983.

*Primary Examiner*—Robert C. Watson

*Attorney, Agent, or Firm*—Harness, Dickey & Pierce, P.L.C.

[57] ABSTRACT

A fastening apparatus includes a spring operable to inwardly bias a pair of die blades toward an anvil. In one aspect of the present invention, the anvil and die blades act in conjunction with a punch to form either an interlocking lanced joint or a contiguous, leakproof, inverted mushroom-shaped joint. In another aspect of the present invention, the anvil has a flat external face. In yet another aspect of the present invention, the spring includes a pair of spring arms joined by a bridge. In still another aspect of the present invention, the spring extends around an external surface of a die body. In a further aspect of the present invention, a discontinuous contact surface of the anvil is provided.

29 Claims, 3 Drawing Sheets

FASTENING APPARATUS

BACKGROUND AND SUMMARY OF THE INVENTION

The present invention relates generally to fastening apparatuses and specifically to a fastening apparatus having an anvil and at least an inwardly biased pair of movable die blades.

It is well known to provide a device for joining a plurality of material sheets by punching or otherwise manipulating them to cause their deformation into an interlocking relationship in a localized area. Examples of such conventional joints can take the form of interlocking lanced joints and leakproof, inverted mushroom-shaped joints which rely upon a punch to longitudinally compress two or more sheets of metal or other material against a die anvil. Creation of both joint types cause a joint button to be formed whereby the localized material is transversely extruded larger than the punched area. The button area of the joint retains the sheets of material in interlocking engagement. One such lanced joint is known within the industry as a Lance-N-Loc® joint while the contiguous, leakproof, inverted mushroom-shaped joint is known as a Tog-L-Loc® joint. Such joints are further disclosed within the following U.S. Patents: U.S. Pat. No. 5,267,383 entitled "Apparatus for Joining Sheet Material" which issued to E. Sawdon on Dec. 7, 1993; U.S. Pat. No. 5,031,442 entitled "Punch Anvils for Sheet Fastening Systems" which issued to Kynl on Jul. 16, 1991; U.S. Pat. No. 4,757,609 entitled "Apparatus for Joining Sheet Material" which issued to E. Sawdon on Jul. 19, 1988; and U.S. Pat. No. 4,459,735 entitled "Joining Sheet Metal" which issued to E. Sawdon on Jul. 17, 1984; all of which are incorporated by reference herewithin.

Another traditional tool employed to form sheet material joints is disclosed within U.S. Pat. No. 4,803,767 entitled "Clinching Tool" which issued to Obrecht et al. on Feb. 14, 1989. This device includes a collet, made from tool steel, having a plurality of spring fingers upstanding from a base portion which appears to circumferentially surround a pin. Alternately, this reference shows the use of a urethane sleeve instead of the collet fingers.

It is also noteworthy that insert or punch patterns are shown in U.S. Pat. No. 3,022,687 entitled "Method of Riveting" which issued to Richards on Feb. 27, 1962, and in JP 4-284928A to Toyota Motor Corp. U.S. Pat. No. 3,771,216 entitled "Method and Tooling For Extruding A Closed End Rivet" which issued to Johnson on Nov. 13, 1973, appears to disclose an anvil having a convexly curved end face. Furthermore, U.S. Pat. No. 1,919,999 entitled "Machine for Forming and Fastening" which issued to Borton on Jul. 25, 1933, appears to disclose a machine which employs grooved jaws for engaging material strips. However, these jaws do not act in cooperation with a pair of die blades and a punch to form a material joint.

In accordance with the present invention, the preferred embodiment of a fastening apparatus includes a spring operable to inwardly bias a pair of die blades toward an anvil. In one aspect of the present invention, the anvil and die blades act in conjunction with a punch to form either an interlocking lanced joint or a contiguous, leakproof, inverted mushroom-shaped joint. In another aspect of the present invention, the anvil has a flat external face. In yet another aspect of the present invention, the spring includes a pair of spring arms joined by a bridge. In still another aspect of the present invention, the spring extends around an external surface of a die body such that internal bores within the die body are not required for supporting the spring. In a further aspect of the present invention, a discontinuous contact surface of the anvil is provided.

The present invention fastening apparatus is advantageous over conventional devices since the present invention provides for an easily manufactured and assembled spring. Thus, reduced manufacturing costs and assembly costs are achieved while improving spring forces, robustness and spring durability. Additionally, the present invention is advantageous by employing a die body and anvil which do not require strength reducing bores therethrough. This allows for increased die durability during prolonged use and misuse due to punch misalignment and excessive punching force. A further advantage of the present invention is that the grooved anvil more effectively engages with the sheets of material thereby slowing down or stopping the movement of the sheets during the joint forming; this provides for more efficient energy transfer and joint strength. Additional advantages and features of the present invention will become apparent from the following description and appended claims, taken in conjunction with the accompanying drawings.

DETAILED DESCRIPTION OF THE PREFERRED EMBODIMENT

Figure 1:
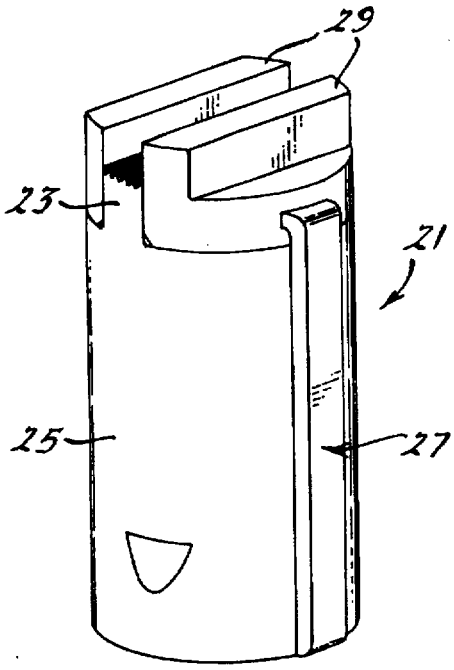
FIG. 1 is a perspective view showing the preferred embodiment of a fastening apparatus of the present invention.
Figure 2:
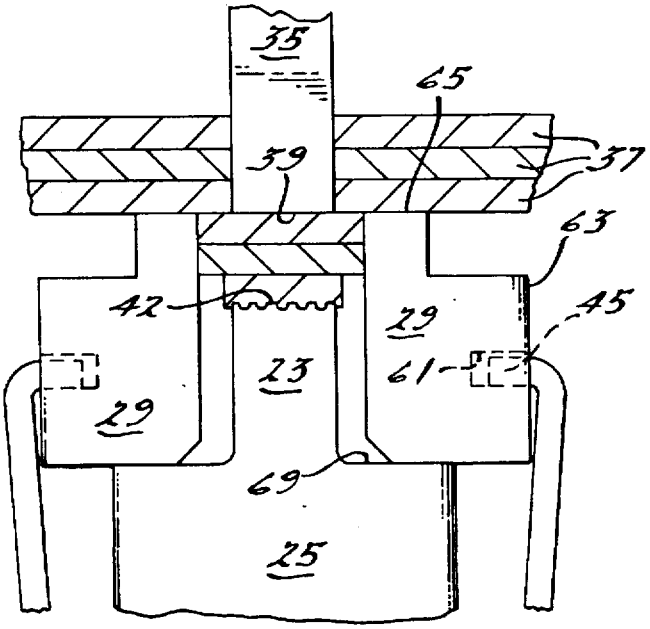
FIG. 2 is an enlarged, fragmentary side elevational view showing the preferred embodiment fastening apparatus of the present invention forming a lanced joint within three sheets of material.
Figure 3:
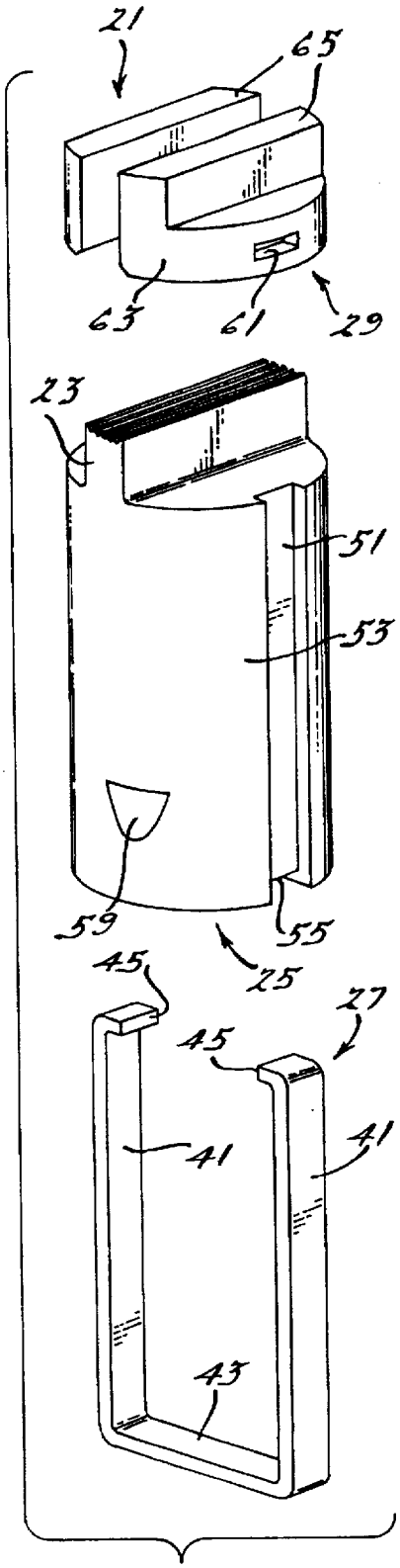
FIG. 3 is an exploded perspective view showing the preferred embodiment fastening apparatus of the present invention.
Figure 4:
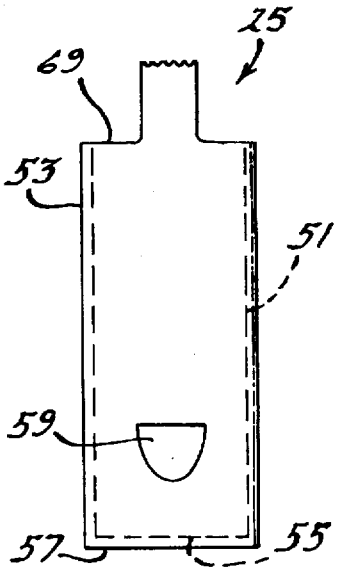
FIG. 4 is a side elevational view showing a die body and anvil employed in the preferred embodiment fastening apparatus of the present invention.
Figure 5:
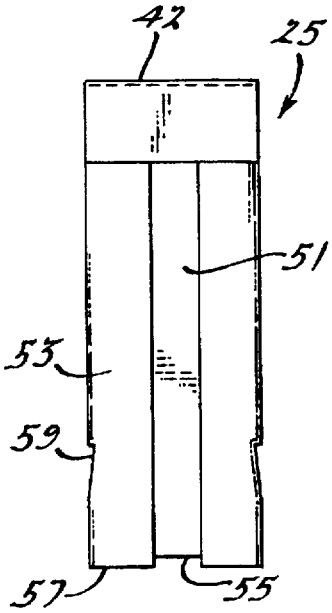
FIG. 5 is a side elevational view, taken perpendicular to that of FIG. 4, showing the die body and anvil employed in the preferred embodiment fastening apparatus of the present invention.
Figure 8:
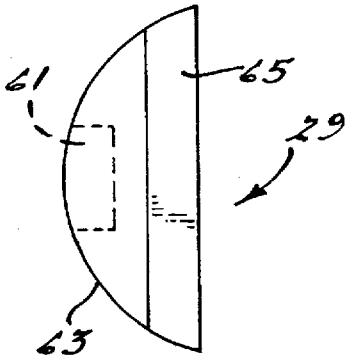
FIG. 8 is a top elevational view showing a die blade employed in the preferred embodiment fastening apparatus of the present invention.
Figure 9:
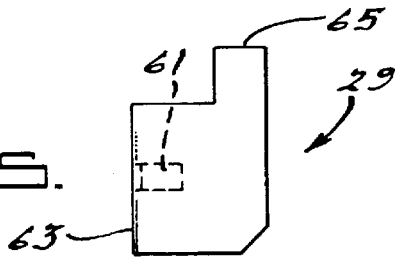
FIG. 9 is a side elevational view showing the die blade employed in the preferred embodiment fastening apparatus of the present invention.

Referring to FIGS. 1–3, the preferred embodiment of a fastening apparatus 21 of the present invention includes an anvil 23, a die body 25, a spring 27 and a pair of die blades 29. Anvil 23 is integrally formed with die body 25 and both are machined from a high speed steel having a titanium nitrite coating. Fastening apparatus 21 further includes a punch 35 which serves to create a lanced joint within two or more sheets of material 37 such as sheet steel or aluminum. Of course, other metallic or non-metallic material sheets may be employed. A working surface 39 of punch 35 then acts to longitudinally compress the displaced sections of material against a contacting surface 42 of anvil 23. These displaced sections of material are thus caused to transversely expand beyond the punched hole thereby creating a joint button between these sheets of material. The transverse expansion of these displaced sections of material act to transversely slide die blades 29 away from anvil 23.

Spring 27 preferably is defined by a pair of longitudinally oriented spring arms 41 joined by a bridge 43 thereby creating a U-shaped configuration. A finger 45 is inwardly turned in a transverse manner from a distal end of each spring arm 41. Spring 27 is preferably stamped and then formed from a 1074 grade of spring steel which is subsequently heat treated to a rockwell hardness of 5256. In a flat state, spring 27 is 0.18 inches thick.

As can best be observed in FIGS. 1 and 3–5, die body 25 has a pair of oppositely facing longitudinal grooves 51 machined within an otherwise cylindrical external surface 53 thereof. Die body 25 further has a transverse groove 55 machined along a base surface 57 thereof. Spring arms 41 are nominally disposed within at least a portion of longitudinal grooves 51 while bridge 43 is disposed within transverse groove 55. This prevents undesired dislocation of spring 27 in relation to the die assembly during use. Furthermore, as is illustrated in FIGS. 1–3 and 8–10, fingers 45 of spring 27 engage into a pocket 61 machined within a longitudinally oriented external surface 63 of each die blade 29. Furthermore, spring arms 41 further serve to bias die blades 29 toward anvil 23. Die blades 29 primarily slide away from anvil 23 in a transverse manner. Accordingly, these hook-like fingers 45 of spring 27 serve to prevent die blades 29 from lifting off of stepped portions 69 of die body 25 during button expansion. It is also significant that bores or other passageways need not be created through die body 25, especially directly behind anvil 23, for retaining or otherwise assisting spring 27. It has been found that such spring retention bores within conventional constructions have severely weakened the column strength and durability of competitive anvils and die bodies. This conventional problem is especially apparent when joints are formed within sheets of steel material. Therefore, the die body external grooves and the externally mounted spring of the present invention circumvent this traditional problem. The present invention's strength increase is due to the elimination of the conventional spring retention holes and thus an increased surface area along the shoulder portions of die body 69 and the corresponding die blades 63 during initial formation of the joint prior to full transverse die blade movement; this allows more force to be applied when joining harder materials such as steel. Die body 25 further has a pair of semi-conical undercuts 59 machined therein which engage with a screw head for fastening die body 25 to a C-shaped clinching tool clamp or other work surface.

Die blades 29 each have a transversely oriented shoulder 65 for supporting sheets of material 37 transversely outward of the lanced hole. These shoulders 65 longitudinally project beyond contacting surface 42 of anvil 23. It should further be appreciated that each die blade 29 may have an off-set external transverse surface (as shown), one entirely coincidental with die body 25 or a surface sloping therebetween.

Figure 6:
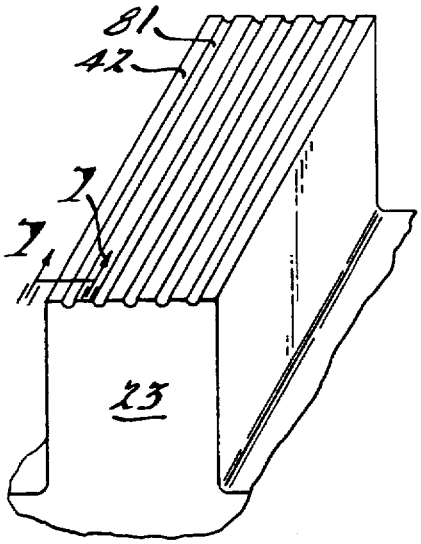
FIG. 6 is an enlarged perspective view showing the anvil employed in the preferred embodiment fastening apparatus of the present invention.
Figure 10:
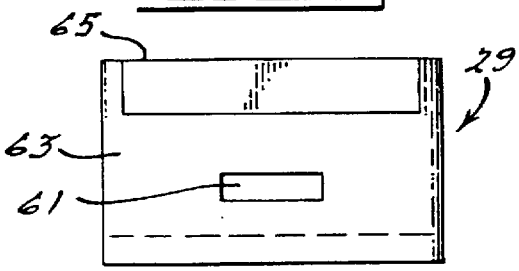
FIG. 10 is a side elevational view, taken perpendicular to that of FIG. 9, showing the die blade employed in the preferred embodiment fastening apparatus of the present invention.
Figure 7:
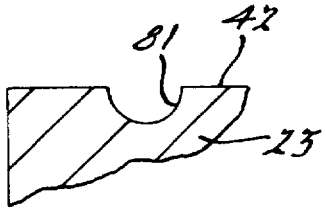
FIG. 7 is an enlarged, fragmentary cross sectional view, taken along line 7—7 of FIG. 6, showing the anvil employed in the preferred embodiment fastening apparatus of the present invention.

Referring now to FIGS. 2, 6 and 7, anvil 23 preferably has a substantially rectangular transverse shape thereto for use in the lanced joint formation. Contacting surface 42 additionally has five parallel and transversely oriented, depressed grooves 81 cut therealong. Each groove preferably has a radius of 0.010 inches below the coplanar contacting surface 42. The displaced section of material 37 disposed closest to anvil 23 will be deformed into grooves 81 when compressed by punch 35. This will cause the material being joined to lock onto anvil 23 thereby slowing down or stopping movement of the sheets of material 37 for joint forming since they quickly pass into and then out of the joint forming stage employing the present invention. Moreover, the energy required to join the sheets of material 37 is then transferred to the other sheets being joined so as to cause them to further expand in contrast to the sheet located closest to and touching the anvil 23. This provides for increased metal to flow out past the die side sheet for creating a stronger joint. Not only does this accomplish a visually identifiable joint, but the final button size is easier to measure.

Figure 11:
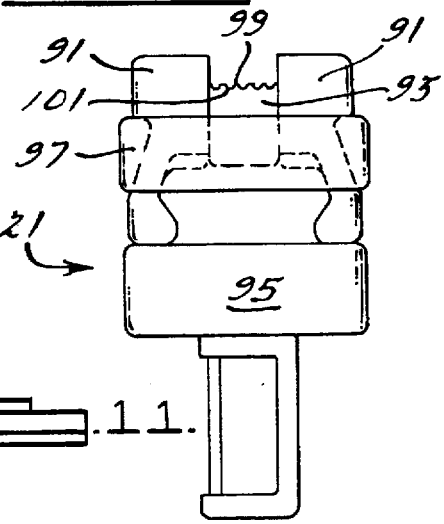
FIG. 11 is a side elevational view showing a first alternate embodiment fastening apparatus of the present invention.

FIG. 11 shows a first alternate embodiment of the fastening apparatus of the present invention 21. Within this embodiment, a pair of pivoting die blades 91 are movably retained against an anvil 93 projecting from a multi-piece die body 95 by a polymeric elastomer 97. The elastomer 97 has an annular shape. A contacting surface 99 of this anvil 93 further has a plurality of grooves 101 running therealong as was disclosed with the preferred embodiment.

Figure 12:
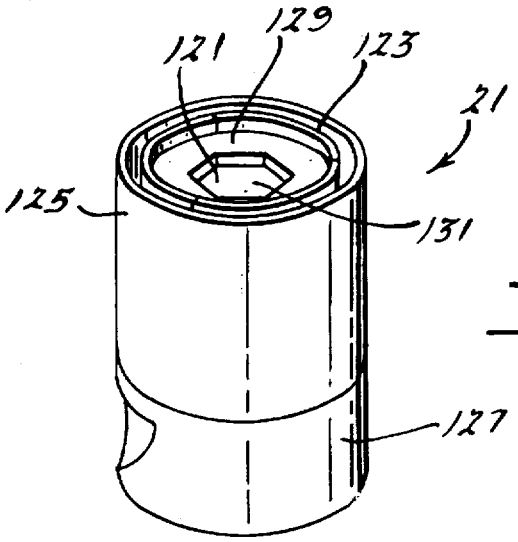
FIG. 12 is a perspective view showing a second alternate embodiment of the fastening apparatus of the present invention.
Figure 13A:
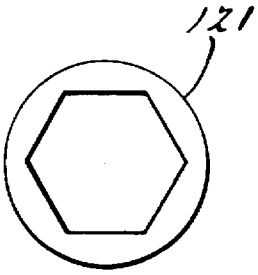
FIGS. 13*a–f* are top elevational views showing anvils employed in the second alternate embodiment fastening apparatus of the present invention.
Figure 13B:
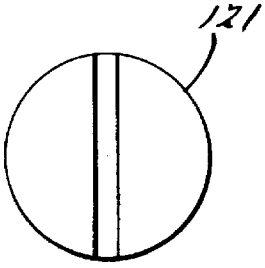
Figure 13C:
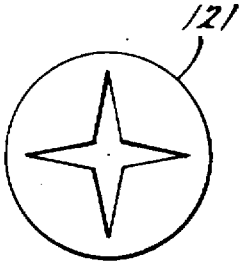
Figure 13D:
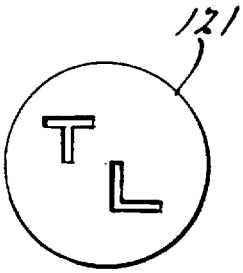
Figure 13E:
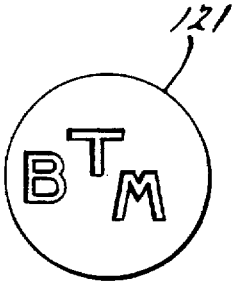
Figure 13F:
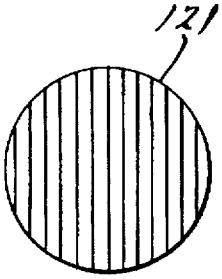

FIG. 12 shows a second alternate embodiment of the fastening apparatus of the present invention 21. A cylindrically-shaped anvil 121 is surrounded by three movable die blades 123 retained and biased within an outer sleeve 125 of a die body 127 by a canted, coiled spring (not shown). This die assembly is used to create the aforementioned leakproof type joint. A material contacting surface 129 of anvil 121 is provided with one of the raised or depressed discontinuous surfaces 131 illustrated in FIGS. 13*a–f*. FIG. 13*a* depicts a socket head cap screw or hex bolt pattern. FIG. 13*b* shows a screwdriver slot pattern. FIG. 13*c* illustrates a Phillips head screwdriver pattern. FIGS. 13*d* and 13*e* display lettered patterns while FIG. 13*f* shows a grooved pattern similar to that of FIGS. 6 and 7. Alternately, the afore-disclosed or other quantities, shapes, and patterns of grooves and contacting surfaces may be employed in combination with the lanced joint and leakproof joint anvils of the present invention. For example, a starburst pattern or knurled configuration can be used.

While the preferred embodiment of this fastening apparatus has been disclosed, it will be appreciated that various modifications may be made without departing from the present invention. For example, the spring construction can also be incorporated into a contiguous, mushroom-shaped leakproof joint-forming die assembly like that of FIG. 12. In another alternative embodiment, a pair of leaf spring-type arms, without a bridging segment, may be screwed or otherwise attached to portions of the die body for flexibly retaining the die blades. In yet another alternate configuration, the disclosed spring fingers may be replaced by separately assembled bolts, rivets or other engaging means. Moreover, two or more of the disclosed springs may be integrally or separately employed to bias three or more die blades toward an anvil. Various materials and patterns have been disclosed in an exemplary fashion, however, a variety of other materials and patterns may of course be employed. It is intended by the following claims to cover these and any other departures from the disclosed embodiments which fall within the true spirit of this invention.

The invention claimed is:

1. A fastening apparatus comprising:

an anvil having a material contacting surface and external faces, at least one of said external faces being substantially flat;

die blades being movably disposed adjacent to said external faces of said anvil; and each of a set of longitudinally oriented spring arms engaging a respective one of said die blades for biasing said die blades toward said anvil, a bridge joining said spring arms to define a substantially U-shaped member.

2. The fastening apparatus of claim 1 further comprising a die body extending from said anvil and having said spring arms mounted to said die body.

3. The fastening apparatus of claim 2 further comprising a pair of oppositely disposed and longitudinally oriented grooves located along an external surface of said die body, a transversely oriented groove located along a base surface of said die body, said spring arms being at least partially positioned within said longitudinally oriented grooves, said bridge being at least partially positioned within said transversely oriented groove;

whereby said spring arms are retained to said die body without requiring bores in said die body and in said anvil.

4. The fastening apparatus of claim 2 further comprising substantially transversely oriented shoulders located between said external faces of said anvil and a longitudinally oriented external surface of said die body, said die blades directly sliding along said shoulders in a primarily linear manner.

5. A fastening apparatus comprising:

a die body having an external surface;

an anvil having a material contacting surface and at least one external face, said anvil extending from said die body;

die blades being movably disposed adjacent to said at least one external face of said anvil;

each of a set of longitudinally oriented spring arms engaging a respective one of said die blades for biasing said die blades toward said anvil; and a pair of oppositely disposed and longitudinally oriented grooves disposed on said external surface of said die body, said spring arms being at least partially positioned in said grooves, said spring arms being joined to each other at a location below said anvil.

6. The fastening apparatus of claim 1 wherein said spring arms have a substantially uniform thickness, said spring arms further have a greater transverse width as compared to said thickness, said spring arms also have a relatively greater longitudinal length as compared to said transverse width, said spring arms have a substantially uniform rectangular cross sectional shape.

7. The fastening apparatus of claim 1 further comprising a punch operable in conjunction with said anvil and said die blades to create a lanced joint between at least two sheets of material.

8. A fastening apparatus comprising:

a pair of die blades;

a substantially U-shaped spring comprising a pair of spring arms joined by a bridge, said spring engaging said pair of die blades so as to bias said pair of die blades toward each other; and an anvil being stationarily disposed between said pair of die blades;

said bridge of said spring being directly disposed behind said anvil.

9. The fastening apparatus of claim 8 further comprising a die body disposed between said anvil and said bridge of said spring, said spring being located adjacent to external surfaces of said die body whereby internal bores are not required within said die body and said anvil for supporting said spring.

10. A fastening apparatus for joining at least two sheets of material, said apparatus comprising:

a pair of die blades;

a substantially U-shaped spring comprising a pair of spring arms joined by a bridge, said spring engaging said pair of die blades so as to bias said pair of die blades toward each other; and a punch operable in conjunction with said anvil and said die blades to create a lanced joint from longitudinally displaced and transversely expanded sections of the at least two sheets of material.

11. A fastening apparatus for joining sheets of material, said apparatus comprising:

a pair of die blades;

a substantially U-shaped spring comprising a pair of spring arms joined by a bridge, said spring engaging said pair of die blades so as to bias said pair of die blades toward each other; and a punch operable in conjunction with an anvil and said pair of die blades to create a leakproof, interlocking, inverted mushroom-shaped joint between the sheets of material.

12. The fastening apparatus of claim 8 further comprising:

a pocket being disposed in an exterior surface of each of said pair of die blades; and a finger inwardly projecting from each of said pair of spring arms for engaging in said pockets of said pair of die blades.

13. The fastening apparatus of claim 8 wherein said pair of spring arms have a substantially uniform thickness, said pair of spring arms further have a greater transverse width as compared to said thickness, said pair of spring arms also have a relatively greater longitudinal length as compared to said transverse width, said width is substantially uniform along said longitudinal length, each of said pair of spring arms has a substantially uniform rectangular cross sectional shape.

14. A fastening apparatus comprising:

an anvil;

a set of die blades disposed adjacent to said anvil; and a spring including at least a pair of spring arms, said pair of spring arms having a substantially uniform thickness, said spring arms further having a greater transverse width as compared to said thickness, said spring arms also having a relatively greater longitudinal length as compared to said transverse width, said width being substantially uniform along said longitudinal length, said spring arms biasing said set of die blades toward each other, each of said spring arms having a substantially uniform rectangular cross sectional shape, said spring arms all being joined to each other at a location below said anvil.

15. The fastening apparatus of claim 14 further comprising a finger inwardly projecting from a distal end of each of said pair of spring arms, said fingers engaging within pockets disposed in said set of die blades.

16. A fastening apparatus for forming a joint in sheets of material, said apparatus comprising:

an anvil having a discontinuous material contacting surface; and die blades being transversely disposed adjacent to said anvil, a shoulder of each of said die blades engaging one of said sheets of material, said shoulders longitudinally extending beyond said contact surface of said anvil, said die blades being transversely movable away from said anvil when said joint is formed.

wherein said discontinuous material contacting surface impresses a discontinuous pattern in substantially a center of said joint when said joint is formed.

17. The fastening apparatus of claim 16 wherein said discontinuous surface is defined as a plurality of grooves each having a radius as cross sectionally viewed.

18. The fastening apparatus of claim 17 wherein said radius of each of said plurality of grooves is less than 0.020 inch.

19. The fastening apparatus of claim 16 wherein said contacting surface of said anvil is substantially disposed along a single plane.

20. The fastening apparatus of claim 16 wherein said discontinuous surface is further defined as at least three grooves running substantially parallel to each other.

21. The fastening apparatus of claim 16 further comprising a punch operable in conjunction with said anvil and said die blades to create a lanced joint from longitudinally displaced and transversely expanded sections of at least two sheets of material.

22. The fastening apparatus of claim 16 wherein said discontinuous surface is further defined as a screwdriver slot pattern.

23. The fastening apparatus of claim 16 wherein said discontinuous surface is further defined as a Phillips head screwdriver pattern.

24. The fastening apparatus of claim 16 wherein said discontinuous surface is further defined as a socket head pattern.

25. The fastening apparatus of claim 16 wherein said discontinuous surface is further defined as a bolt head pattern.

26. The fastening apparatus of claim 16 wherein said discontinuous surface is further defined as a letter pattern.

27. The fastening apparatus of claim 16 further comprising a spring including a pair of spring arms, said pair of spring arms having a substantially uniform thickness, said pair of spring arms further having a greater transverse width as compared to said thickness, said pair of spring arms also having a relatively greater longitudinal length as compared to said transverse width, said width being substantially uniform along said longitudinal length.

28. The fastening apparatus of claim 16 wherein said anvil is longitudinally stationary.

29. A fastening apparatus comprising a die body having a pair of oppositely disposed and longitudinally projecting grooves along an external surface, a transversely oriented groove being disposed along a base surface of said die body, an anvil being located upon said die body substantially opposite from said base surface, a set of die blades being movably positioned adjacent said anvil, and a spring biasing said set of die blades toward said anvil, portions of said spring being disposed within said grooves of said die body.

* * * * *

UNITED STATES PATENT AND TRADEMARK OFFICE

CERTIFICATE OF CORRECTION

PATENT NO. : 5,737,819

DATED : April 14, 1998

INVENTOR(S) : Stephen E. Sawdon; Edwin G. Sawdon; Gregory K. Allison

It is certified that error appears in the above-indentified patent and that said Letters Patent is hereby corrected as shown below:

Column 10, line 21, delete "®".

Signed and Sealed this

First Day of September, 1998

*Attest:*

*Attesting Officer*

BRUCE LEHMAN

*Commissioner of Patents and Trademarks*